United States Patent [19]

Levitt

[11] 4,311,356

[45] Jan. 19, 1982

[54] TRANSDUCER HEAD HAVING PIN TYPE CONNECTORS

[76] Inventor: Myron B. Levitt, 55 Maplewood Dr., Plainview, N.Y. 11803

[21] Appl. No.: 114,575

[22] Filed: Jan. 23, 1980

[51] Int. Cl.[3] ..... H01R 4/24

[52] U.S. Cl. ..... 339/99 R; 339/147 R; 339/176 MF; 360/129

[58] Field of Search ..... 339/17 F, 176 MF, 97 R, 339/97 P, 98, 99, 147 R; 360/122, 129

[56] References Cited

U.S. PATENT DOCUMENTS

| | | | |
|---|---|---|---|
| 2,922,231 | 1/1960 | Witt et al. | 360/129 |
| 3,434,093 | 3/1969 | Wedekind | 339/17 F |
| 3,444,506 | 5/1969 | Wedekind | 339/17 F |
| 3,858,159 | 12/1974 | Worth | 339/176 MF |
| 4,035,050 | 7/1977 | Volinskie | 339/176 MF |
| 4,044,392 | 8/1977 | Brock et al. | 360/129 |

*Primary Examiner*—John McQuade
*Attorney, Agent, or Firm*—Frishauf, Holtz, Goodman and Woodward

[57] ABSTRACT

A transducer head, and in particular a magnetic reading and/or writing head having a plurality of reading and/or writing tracks has a connector at the rear end thereof having a plurality of pins which are adapted to pierce and engage the conductors of a substantially flat ribbon-type multi-conductor wire. The connecting pins of the connector have generally fork-shaped ends which are adapted to pierce the insulation and engage a conductor between the opposing members of the fork-shaped ends. A cover is provided which is removable only upon application of a predetermined amount of force to prevent accidental or unauthorized opening of the connector.

23 Claims, 16 Drawing Figures

FIG. 1
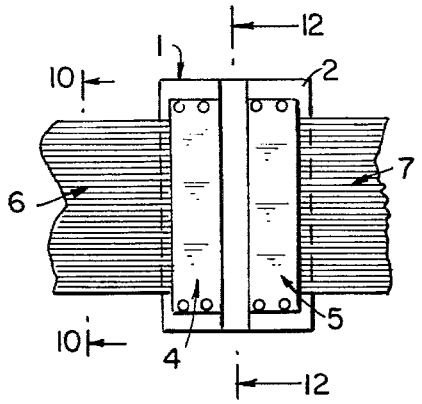
FIG. 2
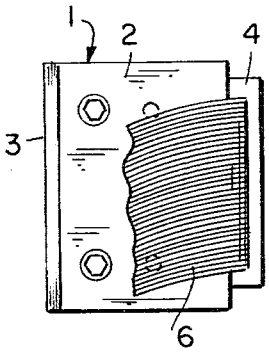
FIG. 3
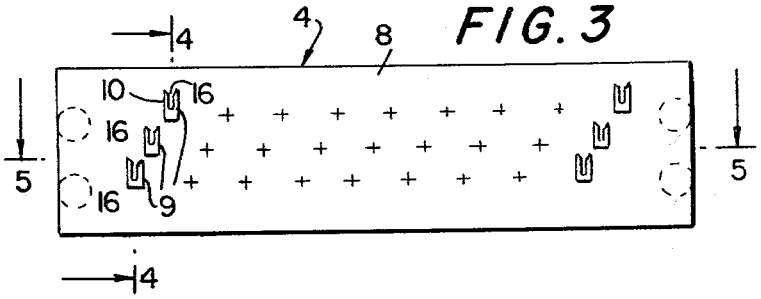
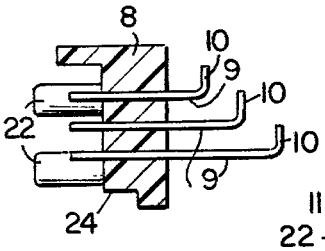
FIG. 4
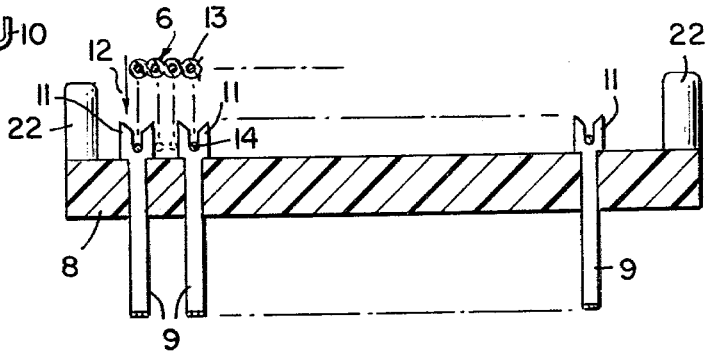
FIG. 5

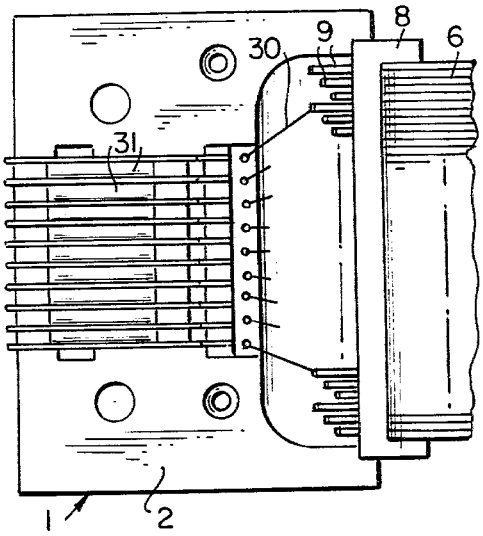
FIG. 12
FIG. 15
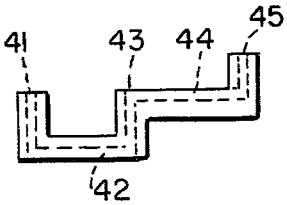
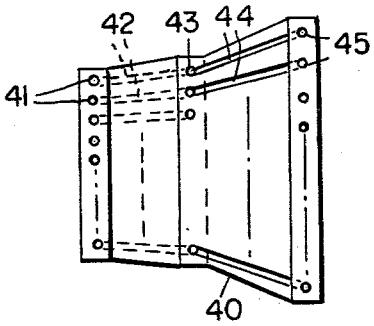
FIG. 16
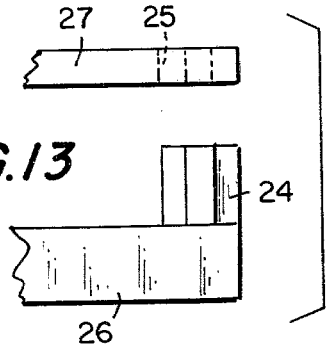
FIG. 13
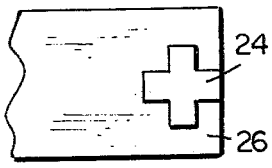
FIG. 14

TRANSDUCER HEAD HAVING PIN TYPE CONNECTORS

BACKGROUND OF THE INVENTION

This invention relates to transducers, and more particularly, to head-like transducers for use with, for example, magnetic tape, magnetic discs, optical information systems, or the like.

While the invention is applicable to various types of transducer heads, the invention will be described in detail herein in connection with a magnetic head for use in recording and/or reading information on a magnetic medium, such as magnetic tape, magnetic discs, or the like.

Most prior art magnetic heads have their lead wires permanently attached thereto, the lead wires extending from, for example, the rear of the magnetic head. Attempts have been made to provide a plug-in type head, but no satisfactory solution has heretofore been found whereby the head may be easily and inexpensively manufactured and reliably connected to the necessary lead wires.

The object of the present invention is to provide a plug-in type head which is easy to manufacture and which provides reliable connection of the lead wires to the head. A further object is to provide such an arrangement wherein the lead wires will be held in position in a secure and reliable manner, and wherein reworking of the assembly can be carried out with a minimum of difficulty.

SUMMARY OF THE INVENTION

In order to accomplish the above objects, a transducer head arrangement of the present invention comprises a housing having a plurality of information reading and/or writing means in the housing; a connector mounted to the housing and having a plurality of connecting elements, such as pins, connected to the information reading and/or writing means; a substantially flat ribbon-type multi-conductor wire having insulation surrounding each conductor and separating the conductors from each other, the ribbon-type wire being pressed on said connector such that the connecting elements of the connector pierce the insulation and contact respective conductors of the ribbon-type wire; and cover means over said connector to enclose said connector elements and pierced ribbon-type wire.

In a preferred embodiment, the transducer head is a magnetic head having a plurality of magnetic tracks, each magnetic track including at least one electrical coil. The connector is preferably permanently mounted to the housing of the head.

In a further preferred embodiment, the connecting elements of the connector extend through the connector and into the interior of the housing, the connecting elements being pin-like members having up-turned ends, the up-turned ends preferably being bifurcated, to facilitate connection of wires to the connecting elements interior of the housing.

BRIEF DESCRIPTION OF THE DRAWINGS

FIG. 1 is a rear view of a magnetic head fabricated in accordance with the present invention;

FIG. 2 is a side view thereof;

FIG. 3 is an enlarged rear view of the connector of the present invention as viewed from the interior of the housing of the magnetic head;

FIG. 4 is a sectional view of the connector of FIG. 3 taken along the line 4—4 in FIG. 3;

FIG. 5 is a sectional view of the connector of FIG. 3 taken along the line 5—5 in FIG. 3;

FIG. 12 is a sectional view of the magnetic head taken along the line 12—12 in FIG. 1;

FIG. 13 is a partial side view of a modified embodiment;

FIG. 14 is a partial top view of the modified connector of FIG. 13;

FIG. 15 is a top view of an insulator member used interior of the magnetic head; and FIG. 16 is a side view of the insulator of FIG. 15.

DETAILED DESCRIPTION

Figure 6:
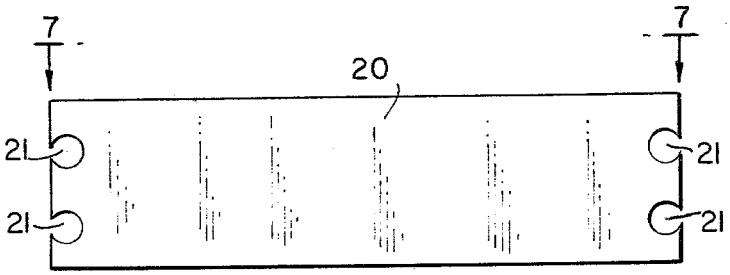
FIGS. 6–8 are rear, top and front views, respectively, of a cover plate for the connector of FIGS. 3–5.
Figure 7:
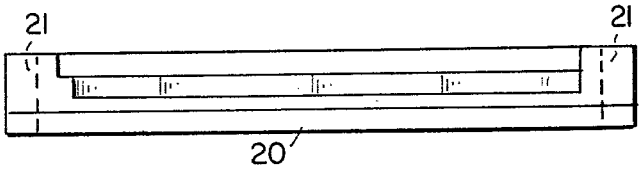
Figure 8:
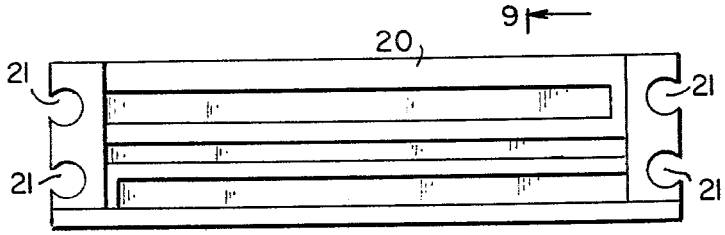
Figure 9:
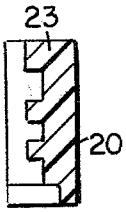
FIG. 9 is a sectional view of the cover plate taken along the line 9—9 in FIG. 8.

Referring to FIGS. 1 and 2 a transducer head 1, such as a magnetic tape head, comprises a housing 2 having a front surface 3 defining a plurality of tracks thereon. The front surface 3 is not shown in detail since such magnetic heads are notoriously well known in the art. A pair of connectors 4,5 are mounted at the rear end of the magnetic head 1 to receive respective flat ribbon-type multi-conductor wires 6,7, the connectors 4,5 interfacing the internal connections of the transducer head with the ribbon-type wires 6,7. p FIGS. 3–5 illustrate the connectors in greater detail. For convenience, only the connector 4 of FIG. 1 will be discussed, the connector 5 being identical. The connector 4 comprises an insulating block 8, for example made of plastic material, with a plurality of metallic connecting elements, such as pins 9 extending through the insulating block 8 from the interior of the head to the exterior thereof. The pins 9 have up-turned ends 10 on the interior side of the head for receiving electrical conductors. The exterior portions 11 of the pins 9 (see FIG. 5) are for receiving and piercing a ribbon-type wire 6.

Figure 10:
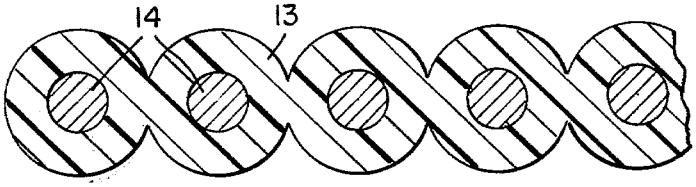
FIG. 10 is an enlarged sectional view of the flat ribbon wire used in the present invention, for example taken along the line 10—10 in FIG. 1.
Figure 11:
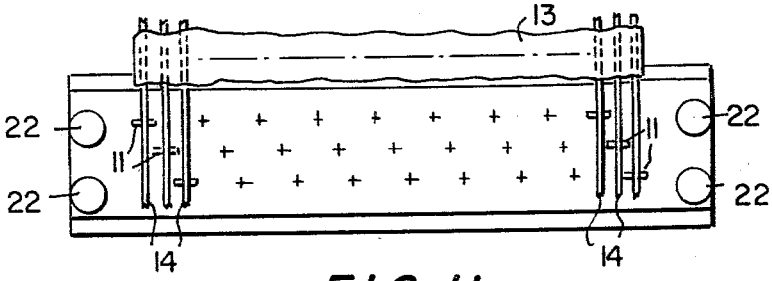
FIG. 11 illustrates the flat ribbon wire pressed onto the connector, but with the cover plate thereof removed so that the connections can be more easily seen.

As shown in FIG. 3, since the spacing between adjacent wires of the ribbon-type wire 6 is very close, the connectors 9 are located in three rows which are staggered relative to each other. When the ribbon-type wire 6 is pressed downwardly in the direction of the arrow 12 in FIG. 5, the connecting portions 11 of the pins 9, which each define a generally V-shaped or U-shaped opening as seen in FIG. 5, pierce the insulation 13 of the ribbon-type wire and contact respective conductors 14 of the ribbon-type wire. See also FIGS. 10 and 11. The connecting portion of each of the pins 9 is defined by a pair of spaced prongs which are spaced apart a small distance so that a high degree of pressure is applied against the conductor 14 which is pressed therebetween to insure good electrical connection. The insulation 13 is pierced by the prongs and tightly encloses the connection portion to protect the connection by preventing contamination of the connection and maintaining the electrical integrity of the connection. The tips of the prongs of connecting portion 11 are sharp to facilitate piercing of the insulation 13 and insertion of the wire 14 therebetween.

As seen in FIG. 3, the up-turned ends 10 of the pins 9 are bifurcated; that is, they have elongated vertically oriented openings 16 so that a wire from the reading and/or writing means may be easily inserted therein prior to permanent connection of the wire to the up-turned ends 10. After the wire is inserted in the elongated opening 16, the permanent connection may be made by soldering, welding, or any other suitable technique.

FIGS. 6–9 illustrate typical cover members for use with the connector illustrated in FIGS. 3–5 and discussed above. After the wire is pressed onto the connecting portions 11 of the pins 9, the cover is pressed onto the connector to effectively protect and seal the rear of the head. The cover 20 has a plurality of openings 21 at the peripheral end portions thereof for engagement with the upstanding projections 22 of the connector (see FIGS. 4 and 5). The upstanding pins or projections 22 have slightly larger diameters than the openings 21 so that an interference fit is provided. Preferably, the interference fit is such that a nominal 8 lb force is required to remove the cover. However, a range of about 5 to 10 lbs would be suitable. This prevents the cover from inadvertently coming off of the connector and also prevents unauthorized removal of the cover from the connector. The cover also has a downwardly extending edge 23 which extends downwardly at the forward end 24 of the connector block (FIG. 4) to bear against the ribbon-type wire so as to act as a strain relief.

In place of the projections 22 and opening 21 configuration of the connector and cover, respectively, an interference fit member such as a projection 24 and opening 25, as illustrated in FIG. 13 could be provided. This arrangement has the advantage that the projection 24 is stronger than the elongated projections 22 of FIGS. 4 and 5 and the possibility of breakage thereof is therefore reduced. In FIG. 13 the block 26 and cover 27 are shown only partially and in enlarged form to better illustrate the concepts involved.

FIG. 14 illustrates a top of projection 24.

FIG. 12 illustrates the interior of a typical magnetic recording head with lead wires 30 extending from the various magnetic coils 31 of the respective tracks of the head to the connector pins 9. The connector pins have up-standing ends at the interior portions thereof to facilitate interconnection of the wires 30 therewith. The up-turned ends have a further advantage in that the connections are accessible from above and the connections may be made by use of wire wrapping techniques.

FIGS. 15 and 16 illustrate an insulator and guide member which guides the lead wires 30 from the respective coils 31 to the respective connector pins 9. See also FIG. 12. The insulator comprises a generally fan-shaped insulating member 40, preferably made of plastic material and having a profile substantially as illustrated in FIG. 15. The insulator 40 has a plurality of bores 41 therein through which respective wires 30 pass from the respective coils 31. The holes 41 open into a plurality of open slots or channels 42 extending toward the underside of the insulator, the open slots 42 each communicating with another hole or bore 43. The bores 43 communicate with respective open slots 44 which guide the respective lead wires to bores 45. The lead wires 30 are each threaded through an associated tortuous path defined by a respective bore 41, open slot 42, bore 43, open slot 44 and bore 45 so as to then extend upwardly adjacent an associated pin 9 of the connector 8. This arrangement facilitates wiring of the head with the connector of the present invention and positively maintains the individual wires 30 separated and insulated from each other.

I claim:

1. In a transducer head arrangement comprising a housing having a plurality of information reading and/or writing means therein;

the improvement comprising the combination of:

a connector fixedly mounted to said housing and including an insulating member and a plurality of electrically conducting connecting elements which extend through said insulating member so as to extend from inside said housing to the outside of said housing, said connecting elements being connected to said information reading and/or writing means inside of said housing, the portions of each of said connecting elements extending outside said housing having means for piercing insulation covering an electrical wire and for electrically contacting the wire covered by the pierced insulation;

a substantially flat ribbon-type multi-conductor wire having insulation surrounding each conductor and separating the conductors from each other, the ribbon-type wire being pressed on said connector with the connecting elements of the connector piercing the insulation and contacting respective conductors of the ribbon-type wire; and cover means coupled to said connector to cover and enclose said connecting elements and the pierced portion of the ribbon-type wire.

2. The transducer head arrangement of claim 1 wherein said connecting elements are pin-like members having up-turned ends interior of said housing for connection to said reading and/or writing means.

3. The transducer head arrangement of claim 2 wherein said up-turned ends are bifurcated to facilitate connection of wires to the connecting elements interior of the housing.

4. The transducer head arrangement of any one of claims 1, 2, or 3 wherein said connecting elements are spaced from each other a predetermined distance so as to be in registration with a respective conductor of said ribbon-type wire.

5. The transducer head arrangement of claim 4 wherein said portions of said connecting elements extending outside of said housing have generally V-shaped openings therein for piercing the insulation of said ribbon-type wire and for electrically engaging and contacting a respective conductor of said ribbon-type wire.

6. The transducer head arrangement of claim 4 wherein said portions of said connecting elements extending outside of said housing have generally U-shaped openings therein for piercing the insulation of said ribbon-type wire and for electrically engaging and contacting a respective conductor of said ribbon-type wire.

7. The transducer head arrangement of claim 6 wherein the ends of said connecting portions of said connecting elements which define said generally U-shaped opening are substantially sharp.

8. The transducer head arrangement of claim 1 wherein said cover means is removably attached to said connector.

9. The transducer head arrangement of claim 8 wherein said connector and cover means comprise mutual engagement means which is mutually disengageable only upon application of a predetermined amount of force to prevent accidental disengagement of said cover means from said connector.

10. The transducer head arrangement of claim 9 wherein said predetermined force is in the range of about 5 to 10 lbs.

11. In a transducer head arrangement comprising a housing having a plurality of information reading and/or writing means therein;

the improvement comprising:

a connector fixedly mounted to said housing and having a plurality of connecting elements connected to said information reading and/or writing means inside of said housing, said connector including an insulating member and a plurality of said connecting elements extending therethrough so as to extend from inside said housing to the outside of said housing, the portions of said connecting elements extending outside of said housing being bifurcated or split so as to pierce the insulation of a substantially flat ribbon-type multi-conductor wire and to contact a respective one of the conductors of said ribbon-type wire after piercing of the insulation thereof; and cover means coupled to said connector to cover and enclose said connector elements and the pierced portion of the ribbon-type wire.

12. The transducer head arrangement of claim 11 wherein said connecting elements have up-turned ends interior of said housing for connection to said reading and/or writing means.

13. The transducer head arrangement of claim 12 wherein said up-turned ends are bifurcated to facilitate connection of wires to the connecting elements interior of the housing.

14. The transducer head arrangement of any one of claims 11–13 wherein the portions of said connecting elements which extend outside of said housing have generally U-shaped openings therein for piercing said insulation and electrically contacting a respective conductor of said ribbon-type wire.

15. The transducer head arrangement of any one of claims 11–13 wherein the portions of said connecting elements which extend outside of said housing have generally V-shaped openings therein for piercing said insulation and electrically contacting a respective conductor of said ribbon-type wire.

16. The transducer head arrangement of claim 15 wherein the ends of said connecting portions of said connecting elements which define said openings are substantially sharp.

17. The transducer head arrangement of claim 11 wherein said cover means is removably attached to said connector and is disengageable therefrom only upon application of a predetermined amount of force.

18. The transducer head arrangement of claim 17 wherein said predetermined force is in the range of about 5 to 10 pounds.

19. In a transducer head comprising a housing having a plurality of information reading and/or writing means therein, a connector mounted to said housing and having a plurality of connecting pins extending interior of said housing, the improvement comprising:

an insulating conductor routing block having a plurality of generally vertically extending first bores (41) at one end thereof in the vicinity of said information reading and/or writing means, a plurality of elongated first open slots (42) extending generally horizontally from respective vertically extending first bores (41), each of said first open slots having two opposite ends, one end of each of said first open slots communicating with a respective first bore, a plurality of generally vertically extending second bores (43) communicating with the ends of respective first open slots (42) which are opposite from the ends of said first open slots which communicate with said first bores (41), a plurality of elongated second open slots (44) extending generally horizontally from respective second bores (43), each of said second open slots having two opposite ends, one end of each of said second open slots communicating with a respective second bore, and a plurality of generally vertically extending third bores (45) communicating with the ends of respective second open slots (44) which are opposite from the ends of said second open slots which communicate with said second bores (43), said third bores (45) being in the vicinity of said connector, said slots and bores defining a plurality of tortuous paths for routing of a plurality of respective wires from said information reading and/or writing means to said pins of said connector.

20. The transducer head of claim 19 wherein said first and second open slots are open to opposite sides of said insulating conductor routing block.

21. The transducer head of claims 19 or 20 wherein said insulator conductor routing block is generally fan-shaped.

22. The transducer head of claim 19 wherein the portion of said insulating conductor routing block defining said first and second bores and said first open slots is generally U-shaped.

23. The transducer head of claim 19, wherein said vertically extending third bores (45) are spaced apart a greater distance than the spacing between respective vertically extending second bores (43), said second open slots (44) extending in a generally fan-shaped manner from respective second bores (43) to respective third bores (45).

* * * * *